US006749725B1

(12) United States Patent
Isometsä et al.

(10) Patent No.: US 6,749,725 B1
(45) Date of Patent: Jun. 15, 2004

(54) BLADE HOLDER FOR A DOCTOR AND A METHOD FOR USING THE DOCTOR

(75) Inventors: Juha Isometsä , Jyväskylä (FI); Jouni Kirjava, Jyväskylä (FI); Matti Pajala, Jyväskylä (FI); Seppo Parviainen, Jyväskylä (FI); Iikka Rata, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 15 days.

(21) Appl. No.: 10/110,175

(22) PCT Filed: Oct. 6, 2000

(86) PCT No.: PCT/FI00/00862

§ 371 (c)(1),
(2), (4) Date: May 13, 2002

(87) PCT Pub. No.: WO01/25533

PCT Pub. Date: Apr. 12, 2001

(30) Foreign Application Priority Data

Oct. 6, 1999 (FI) ..... 19992149

(51) Int. Cl.[7] ..... D21G 3/00; B65G 45/16

(52) U.S. Cl. ..... 162/281; 162/199; 162/272; 15/256.51

(58) Field of Search ..... 162/280–282, 162/264, 198, 199, 272; 15/256.5, 256.51, 256.53; 101/157, 169, 350.6; 118/120–126, 261, 413; 399/284; 427/356; 198/499

(56) References Cited

U.S. PATENT DOCUMENTS

| | | | | |
|---|---|---|---|---|
| 3,800,357 A | * | 4/1974 | Skytta | 15/256.51 |
| 3,803,665 A | * | 4/1974 | Winterburn et al. | 15/256.51 |
| 4,367,120 A | | 1/1983 | Hendrikz | 162/281 |
| 5,356,519 A | * | 10/1994 | Grabscheid et al. | 162/281 |

FOREIGN PATENT DOCUMENTS

| | | |
|---|---|---|
| EP | 0294992 | 12/1988 |
| SU | 129489 | 3/1987 |

* cited by examiner

*Primary Examiner*—Steven P. Griffin
*Assistant Examiner*—Eric Hug
(74) *Attorney, Agent, or Firm*—Fildes & Outland, P.C.

(57) ABSTRACT

A blade holder for a doctor and method for using the doctor is disclosed, in which in the front part there is a throat or similar for the doctor blade of the doctor and which blade holder has loading members connected thereto to press the doctor blade against the surface to be doctored. The blade holder further includes a relatively stiff, slightly flexible frame plate, which incorporates the attachment flange. The blade holder also includes loading devices for directing the force of the loading members onto the frame plate at a distance from the attachment flange, to bend the frame plate and thus press the doctor blade against the surface to be doctored.

9 Claims, 2 Drawing Sheets

8
4
7
2'
6
3
1'
13
2
1
2"
5'
5
12
1"
9'

4
7
6
6'
3
2
1
11

12
1
10
7'
9

Fig. 2a
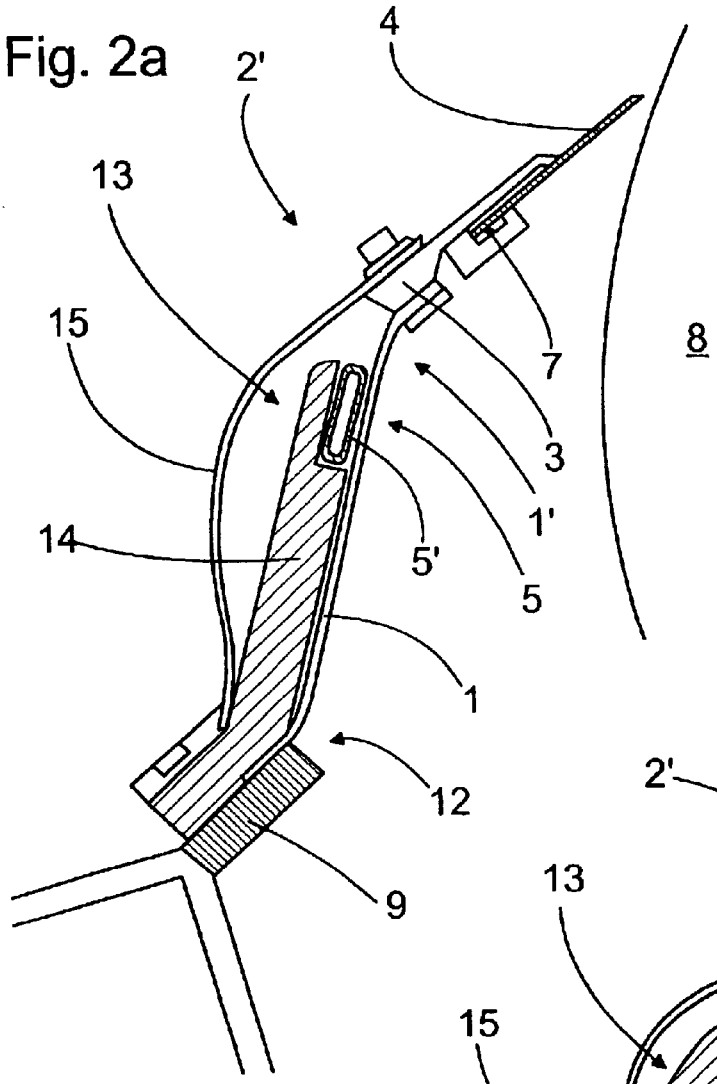
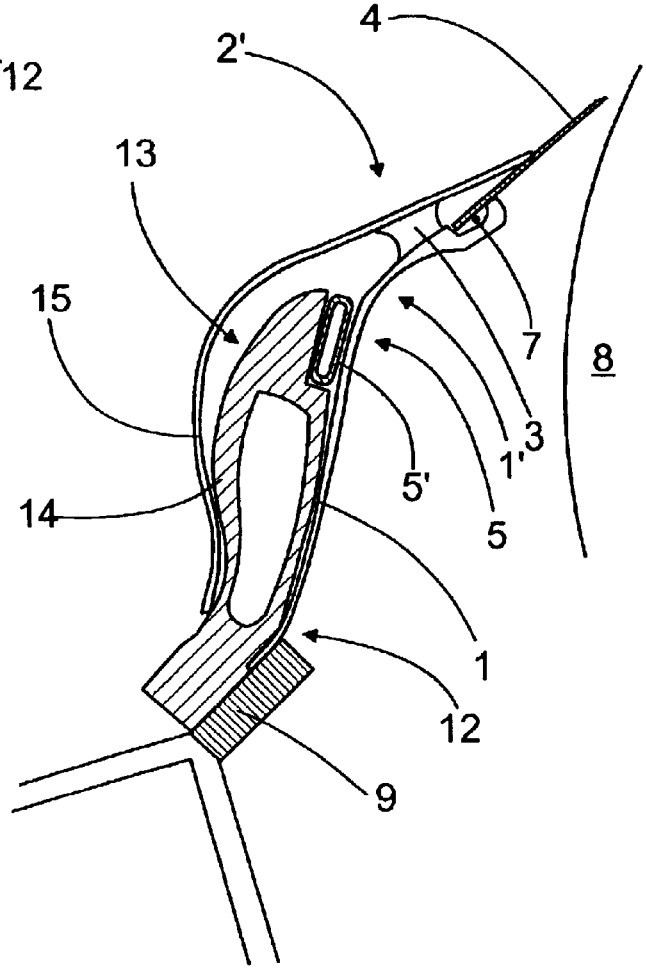
Fig. 2b

BLADE HOLDER FOR A DOCTOR AND A METHOD FOR USING THE DOCTOR

TECHNICAL FIELD

The present invention relates to a blade holder for a doctor, in which in the front part there is a throat or similar for attaching the doctor blade of the doctor and which is intended to be attached from its rear part to the frame by means of an attachment flange, and which blade holder has loading members connected to it to press the doctor blade against the surface to be doctored. The invention also relates to a method for using the doctor.

BACKGROUND OF THE INVENTION

In conventional doctors, there are principally two kinds of blade holder. The first kind are fixed, i.e. rigid blade holders. The second kind, on the other hand, are flexible blade holders. The flexible blade holders can be further divided more precisely into flexible and profiling blade holders. Conventional profiling (flexible) doctors include a blade carrier with a blade holder fitted rotatably to it. Usually, the rotation is implemented by means of bearings, which extend from one end of the doctor to the other. In addition, a doctor blade is fitted to the blade holder, to doctor the surface of a roll or a similar moving surface. In order to alter the position of the doctor blade and to create an adequate blade load, the blade holder is rotated in relation to the blade carrier, by means of loading members. Normally, two loading hoses between the blade carrier and the blade holder, on each side of the bearings, are used as the loading members. Particularly in paper machines, there are numerous such doctors in several different positions. The doctor beam too, with its possible loading members, can also be used to create a basic load on the doctor blade. In rigid blade holders, it is precisely the doctor beam only that loads the doctor blade.

Mainly on account of the bearings, known doctor-blade-holder combinations are extremely complicated and thus also expensive. The bearings contain many moving parts, which wear in use and thus require maintenance. Looseness in the bearings may also have an adverse effect on the doctoring result. A fixed blade holder transmits all the force from the doctor beam to the surface of the roll being doctored. In this case, there is no way of compensating for force variations, installation faults, or similar caused by the bearings or other structures. Profiling and flexible blade holders in general can compensate slightly for these variations, so that the bearing system used in the blade holder is not quite so critical. On the other hand, looseness in the bearings and other structures in the blade holder will cause such detrimental variations. The blade angle of the doctor blade also changes as the doctor blade wears, hampering the operation of the doctor and shortening the doctor blade's service life. In addition, metallic blade holders together with the other components add considerably to the total weight of the doctor. Service costs are further increased by the several different blade-holder models, each of which requires different spare-parts and tools.

SUMMARY OF THE INVENTION

The invention is intended to create a blade holder for a doctor, which contains fewer components than previous known blade holders and which is more economical to manufacture. The invention is also intended to achieve a method for using the doctor, which method is simpler to use and easier to control.

The characteristic features of this invention are provided by a blade holder for a doctor, in which in the front part there is a throat for attaching the doctor blade of the doctor and which is intended to be attached by its rear part to the frame by an attachment flange. The blade holder has loading members connected thereto to press the doctor blade against the surface to be doctored, and is characterized in that the blade holder further includes a relatively stiff, slightly flexible frame plate, which incorporates the attachment flange, and loading devices for directing the force of the loading members on the frame plate at a distance from the attachment flange, in order to bend the frame plate and thus press the doctor blade against the surface to be doctored.

The frame plate may be manufactured from a composite material to form a composite piece and reinforcing fibers of the composite piece are oriented in such a way, that the composite piece is relatively stiff in the lateral direction of the doctor blade and essentially flexible in the longitudinal direction of the doctor blade.

In one arrangement the loading members include one loading hose, which is set between the frame plate and the loading devices, in order to alter the distance between them. The loading devices include a backing plate, which is attached, by a connector at a distance from the frame plate, and the loading members are arranged to affect the distance between the rear parts of the frame plate and the backing plate. The loading members may include a protruding piece adapted to be attached to frame, which extends for a distance from the attachment flange, and in which space for the loading members is arranged.

A method for using a doctor, in which there is a throat in the front part of the blade holder of the doctor for attaching the doctor blade of the doctor and the blade holder is attached from its rear part to the frame by an attachment flange, and the blade holder has loading members connected to it, by means of which the doctor blade is pressed against the surface to be doctored, is characterized in that the blade holder is formed of a relatively stiff, slightly flexible plate forming a frame plate, which is bent by a force, which is directed at a distance from the attachment flange, so that a force pressing against the surface is created in the doctor blade. The force is transmitted with the aid of a stiff blacking plate from a rear part to a front part of the frame plate so that the stiff backing plate is attached by its front part to the frame plate and its rear part is at a distance from the frame plate determined by the loading members. Loading members are located at the end of the protruding piece attached to the attachment flange to act directly on the front part of the frame plate.

A blade holder according to the invention has no bearings or other moving parts at all, instead, the structural components are fitted, to each other. This substantially simplifies the construction of the blade holder. Sufficient movement is created in the doctor blade by means the flexing of the structural components, which is created by means of loading members. In addition, the properties of the blade holder can be adapted by means of the selection of the manufacturing materials. At the same time, the weight of the blade holder is reduced and there is greater freedom of design. The method according to the invention permits the accurate loading of the doctor in a simple, but comprehensive manner.

In the following, the invention is disclosed in detail with reference to the accompanying drawings showing some applications of the invention.

BRIEF DESCRIPTION OF THE DRAWINGS

FIG. 2*a* shows a side view of a partial cross-section of another blade holder of a doctor according to the invention, arranged in connection with a roll, FIG. 2*b* shows a variation of the blade holder of FIG. 2*a*.

DETAILED DESCRIPTION OF THE INVENTION

Figures 1A, 1B, 1C:
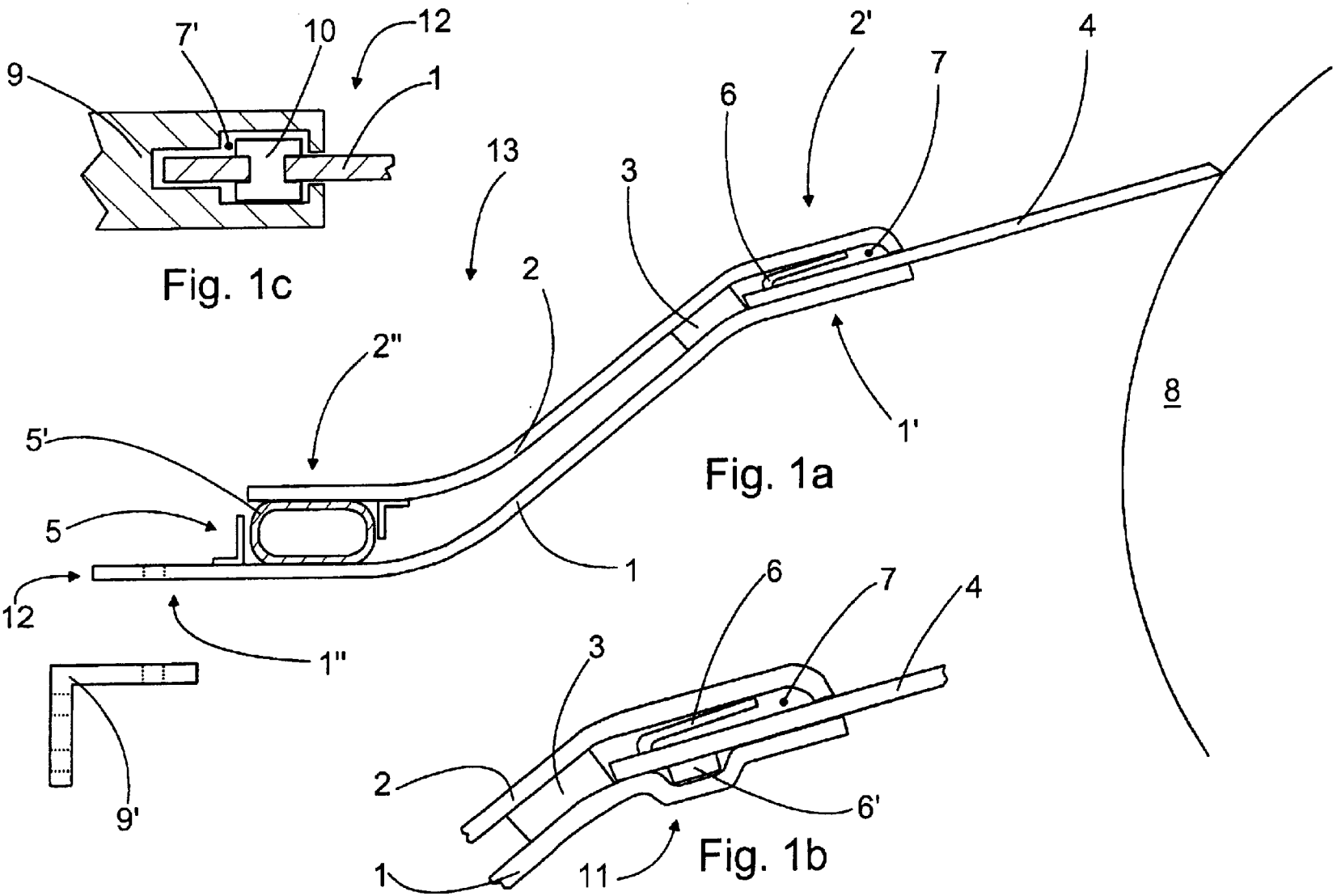
FIG. 1*a* shows a side view of the blade holder of a doctor according to the invention, arranged in connection with a roll.
FIG. 1*b* shows part of an adapted blade holder according to the invention.
FIG. 1*c* shows part of the frame plate of an adapted doctor according to the invention and of its attachment flange.

FIG. 1*a* shows one blade holder of a doctor according to the invention. The blade holder has a throat 7, in which the doctor blade 4 is placed from the side of the doctor. Doctor blade 4 itself is, as such, conventional, and, in this case, doctor blade 4 also includes an attachment spring 6. In some doctor blades, there may also be rivets 6' or similar, for which a space 11 (FIG. 1*b*) might be left in throat 7.

By means of doctor blade 4, some moving surface, such as the surface of the roll 8 of a paper machine, is doctored according to FIG. 1*a*. The blade holder according to the invention may also be freely in other positions than those shown here. The blade holder is attached by an attachment flange 12 of its rear part. The attachment is examined in greater detail in connection with FIG. 1*c*.

The blade holder according to the invention includes a quite stiff, slightly flexible frame plate 1. This frame plate 1 extends essentially over the entire width of the paper machine and contains the said attachment flange 12. In addition, the blade holder includes devices 13 for directing the force creating by the loading members 5 onto frame plate 1, at a distance from the attachment flange 12. This force is used to bend frame plate 1 and thus press doctor blade 4 against the surface to be doctored. In the figures, the same reference numbers are used for components that are functionally similar.

In this case, the plate is sufficiently flexible to be able to be bent by means of the loading members. However, the plate is also sufficiently stiff for it to scarcely bend under its own weight, but to return to its original state when the force of the loading members in removed. In addition, the distance to be moved is set to be such that the plate can be made to bend as desired by using the loading members. In practice, the force is moved closer to the front part of the blade holder.

In FIG. 1*a*, frame plate 1 containing attachment flange 12 is underneath. The other plate is a backing plate 2, the function of which is described later in greater detail. In addition, the plates are connected at their front parts 1' and 2' by means of a connector 3 and at their rear parts 1" and 2" at a short distance from each other by means of loading member 5. Connection 3 is permanently attached to the plates and may be even a pivot. However, in any event, connector 3, together with doctor blade 4, retention spring 6 and throat 7 forms a rigid support between the plates. Thus, there are no moving parts requiring maintenance in the blade holder. In addition, the general construction of the blade holder is simpler than previously.

The doctor blade is set and loaded against the surface to be doctored veritably with the aid of the loading members. Generally, the loading members are set between the frame plate and the devices. In addition, the loading members are arranged to alter the distance between the frame plate and the devices. In the blade holder according to FIG. 1*a*, the loading members 5 are arranged to affect the distance between the rear parts 1" and 2" of the plates. In addition, frame plate 1 is more flexible than backing plate 2, so that the movement of the loading members 5 is converted into movement in doctor blade 4. Backing plate 2, on the other hand, can be quite rigid, as frame plate 1 acts as a kind of spring. Frame plate 1 is selected in such a way that its direction of return is against the effect of loading devices 5. When the pressure of loading members 5 drops, frame plate 1 then flexes, pressing the entire blade holder with doctor blade 4 against roll 8. Further, the blade load of the doctor blade is altered by adjusting the force of the loading members. In FIG. 1*a*, the blade holder is in a loaded state. By increasing the pressure of the loading members, the frame plate bends upwards, and the doctor blade will rise off the surface of the roll (not shown).

The blade holder is manufactured from plates, which simplifies the manufacture of the blade holder. In addition, frame plate 1 is preferably manufactured from a composite material. In that case, the flexing properties of the frame plate can be easily influenced by the suitable orientation of the reinforcing fibres. At the same time, the weight of the blade holder is reduced considerably. In addition, composite materials are easily shaped. Alternatively, both plates are manufactured from a composite material. Further, both plates and the connector can be manufactured as a single composite piece. In that case, the blade holder can be manufactured at one time, for example, using the pultrusion method.

The orientation of the reinforcing fibres in composite pieces is very important. In a blade holder according to the invention, the reinforcing fibres are preferably oriented in such a way that the composite pieces are relatively stiff in the lateral direction of the doctor blade and essentially flexible in the longitudinal direction of the doctor blade, i.e. the lateral direction of the roll. The effect of the loadinig members is then transferred as fully as possible to the doctor blade. On the other hand, a blade holder that is flexible in the longitudinal direction of the doctor blade adapts very well, for example, to the shapes of a curved roll. Correspondingly, if special loading devices are used, it is possible to create a desired loading profile in the doctor blade. These properties can permit even a single type of holder to be manufactured and used in different positions. Besides the selection of the reinforcing fibres, the dimensions of the plates can be used to affect the properties of the blade holder, which can be arranged as desired.

According to FIG. 1*a*, loading members 5 include only a single loading hose 5', which is set between the rear parts 1" and 2" of the plates The loading hose is then well protected between the plates, permitting the use of a conventional loading hose. The length of the working movement of the loading hose also affects the length of the movement of the doctor blade. Deviating from FIG. 1*a*, the direction of movement of the loading hose can be chosen differently, when the operation of the doctor can be set as desired. For example, by rotating the direction of movement of the loading hose 45° clockwise, the doctor blade can be turned even more effectively. The blade holder can be attached simply from frame plate 1. The attachment can be made to the frame 9 of the doctor, or even directly to the frame of the paper machine. On account of its lightness, blade holder manufactured from composite material does not need a separate frame, because it does not bend under its own weight. It is also possible to use an adapter piece 9' (FIG. 1*a*) in the attachment. The attachment flange can also incorporate quick-release devices, making it simple to change the entire blade holder. The quick-release can be according to FIG. 1*c*, in which the rear part 1" of frame plate 1 is attached by means of rivets 10 to the throat 7' in frame 9, in the same manner as the doctor blade. In that case, if the blade holder breaks, the resulting maintenance shutdown will be considerably shorter than usual.

FIGS. 2*a* and 2*b* show two variations of another embodiment of a blade holder according to the invention. The operating principle corresponds to that described above, but in these a direct loading is used. Here, devices 13 include a to frame 9 attached protruding piece 14, which extends a short distance from attachment flange 12. Protruding piece 14 is essentially rigid and forms a loading support. Frame plate 1 and protruding piece 14 are attached directly to, for example, frame 9 of the paper machine. In addition, there is space in protruding piece 14 for loading member 8, so that loading hose 5', which is used as the loading member, will remain firmly in place. In this case too, the blade holder includes a second plate forming a cover plate 15, which is more flexible than frame plate 1. Here, the cover plate has a secondary force effect. In addition, the cover plate supports and protects the blade holder and partly also controls the operation of the blade holder. Both plates are dimensioned in such a way that when the loading member is operated, the doctor blade presses against the surface to be doctored, the blade angle remaining, however, unaltered, despite the wear of the blade. Thus, the blade can be worn to become narrower than previously, without detrimental vibration or so-called biting of the doctor blade.

In the variation of FIG. 2*a*, frame piece 14 is metal. In addition, frame plate 1 and cover plate 15 are attached from their front parts 1' and 2' to a special holder, to which doctor blade 4 is attached. In practice, the holder also forms a connector 3. The combined operation of frame plate 1 and cover plate 15 support doctor blade 4 sufficiently and simultaneously keep the blade angle constant. FIG. 2*b* shows another variation of the blade holder. Here, frame plate 1, cover plate 15, and connector 3 form a throat 7 for doctor blade 4. In addition, connector 3 is made of a flexible material and permits a change in angle between the plates. Gluing, for example, can be used to secure the connector. Protruding piece 14 can also be manufactured as a composite piece, according to FIG. 2*b*. This results in a further reduction in the total weight of the blade holder. The flexible composite pieces can also be manufactured as a unified, closed structure, inside which the protruding piece and the loading hose are placed (not shown). Such a blade holder is compact and its components are well protected.

Advantages are gained from the simple construction of the blade holder, especially in paper machines, in which the rolls used are very wide. The possibility to vary the flexing properties is also important, especially in doctors used with curved rolls. The use of a single kind of blade holders also helps to reduce service costs, as does the simple construction of the blade holder. In addition, a blade holder according to the invention is cheaper to manufacture than an ordinary metal blade holder and suits different kinds of doctor blades. Manufacturing costs are also reduced by the lack of a need for machining, as the composite pieces are ready to use, even without machining.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A blade holder for a doctor, in which in the from part there is a throat for attaching the doctor blade of the doctor and which is intended to be attached by its rear part to a frame by an attachment flange, and which blade holder has loading members connected thereto to press the doctor blade against the surface to be doctored, characterized in that the blade holder further includes a relatively stiff, slightly flexible frame plate, which incorporates the said attachment flange, and loading devices for directing the force of the loading members on the frame plate at a fixed distance from the attachment flange, in order to bend the frame plate and thus press the doctor blade against the surface to be doctored.

2. A blade holder according to claim 1, characterized in that the frame plate is manufactured from a composite material to form a composite piece.

3. A blade holder according to claim 2, characterized in that reinforcing fibers of the composite piece are oriented in such a way, that the composite piece is relatively stiff in the lateral direction of the doctor blade and essentially flexible in the longitudinal direction of the doctor blade.

4. A blade holder according to claim 1, characterized in that the loading members include one loading hose, which is set between the frame plate and the loading devices, in order to after the distance between them.

5. A blade holder according to claim 1, characterized in that the loading devices include a backing plate, which is attached, by a connector at a distance from the frame plate, and that the loading members are arranged to affect the distance between the rear parts of the frame plate and the backing plate.

6. A blade holder according to claim 1, characterized in that the loading members include a protruding piece adapted to be attached to frame, which extends for a distance from the attachment flange, and in which space for the loading members is arranged.

7. A method for using a doctor, in which there is a throat in the front part of the blade holder of the doctor for attaching the doctor blade of the doctor and the blade holder is attached from its rear part to the frame by an attachment flange, and the blade holder has loading members connected to it, by means of which the doctor blade is pressed against the surface to be doctored, characterized in that the blade holder is formed of a relatively stiff, slightly flexible plate forming a frame plate, which is bent by a force, which is directed at a fixed distance from the attachment flange, so that a force pressing against the surface is created in the doctor blade.

8. A method according to claim 7, characterized in that the force is transmitted with the aid of a stiff blacking backing plate from a rear part to a front part of the frame plate so that the stiff backing plate is attached by its front part to the frame plate and its rear part is at a distance from the frame plate determined by the loading members.

9. A method according to claim 7, characterized in that the attachment flange is equipped with a protruding piece at the end of which the loading members are located to act directly on the front part of the frame plate.

* * * * *